US005218943A

United States Patent [19]

Takeda et al.

[11] Patent Number: 5,218,943

[45] Date of Patent: Jun. 15, 1993

[54] FUEL INJECTION APPARATUS FOR INTERNAL COMBUSTION ENGINE

[75] Inventors: Keiso Takeda; Tomojirou Sugimoto, both of Mishima, Japan

[73] Assignee: Toyota Jidosha Kabushiki Kaisha, Toyota, Japan

[21] Appl. No.: 816,390

[22] Filed: Dec. 27, 1991

[30] Foreign Application Priority Data

Jan. 7, 1991 [JP] Japan ..... 3-000118
Jan. 7, 1991 [JP] Japan ..... 3-000141
Jan. 7, 1991 [JP] Japan ..... 3-000142
Jan. 7, 1991 [JP] Japan ..... 3-000143

[51] Int. Cl.[5] ..... F02M 31/00

[52] U.S. Cl. ..... 123/531; 123/549; 123/533; 239/533.12

[58] Field of Search ..... 123/531, 532, 533, 534, 123/432, 470, 549; 239/533.9, 533.12, 585.1, 433

[56] References Cited

U.S. PATENT DOCUMENTS 4,139,158 2/1979 Uchida ..... 239/533.12
4,153,205 5/1979 Parrish ..... 239/533.12
4,394,963 7/1983 Iwata ..... 123/531
4,434,766 3/1984 Matsuoka et al. ..... 123/531
4,846,114 7/1989 List ..... 123/532
4,892,065 1/1990 List ..... 123/532
4,982,716 1/1991 Takeda et al. ..... 123/531
5,040,727 8/1991 Muntean et al. ..... 239/533.9
5,054,458 10/1991 Wechem et al. ..... 123/549
5,062,573 11/1991 Makimura ..... 239/533.12
5,109,824 5/1992 Okamoto et al. ..... 123/432

FOREIGN PATENT DOCUMENTS 59-43669 3/1984 Japan .
61-112773 5/1986 Japan .
64-63648 3/1989 Japan .

*Primary Examiner*—Willis R. Wolfe
*Assistant Examiner*—M. Macy
*Attorney, Agent, or Firm*—Kenyon & Kenyon

[57] ABSTRACT

A fuel injection apparatus, for an internal combustion engine equipped with an air-assist unit for atomizing fuel from a fuel injector, includes a nozzle attached to the end of the injector. The nozzle is provided with a mixture passage, to effect a mixing of the fuel and air from the air-assist unit, and mixture injection ports through which the mixture is ejected to intake ports. Since the mixture passage is longer than each mixture injection port, an equal mix of fuel and air can be effected during the flow thereof in the mixture passage.

17 Claims, 11 Drawing Sheets

FUEL INJECTION APPARATUS FOR INTERNAL COMBUSTION ENGINE

BACKGROUND OF THE INVENTION

1. Field of the Invention

The present invention relates to a fuel injection apparatus for an internal combustion engine, the apparatus comprising a fuel injector equipped with an air-assist unit for atomizing fuel ejected from the fuel injector by blowing air, to thereby improve the combustion and fuel consumption of the internal combustion engine.

2. Description of the Related Art

In general, to ensure that an internal combustion engine attains an effective combustion with a small amount of fuel, it is necessary to supply the fuel into a combustion chamber in an optimum burnable condition.

Accordingly, internal combustion engines equipped with current fuel injectors are provided with fuel injection apparatuses each including an air-assist unit for improving the atomization of the ejected fuel; this unit blowing air from the outside in the vicinity of a fuel injection nozzle opening of the fuel injector (ex. Japanese Unexamined Patent Publication No. 1-271634, Japanese Unexamined Utility Model Publication No. 1-61461 etc.,).

In the above-mentioned conventional apparatus, an adaptor having air-assist holes through which air from the air-assist unit is blown out is attached to a fuel-injection end of the fuel injector. Further, close to the air-assist holes, the adaptor is provided with mixture injection ports for diverging and ejecting a mixture of the fuel and assist air in the desired directions.

In the conventional adaptor, however, since the air-assist holes are arranged close to the mixture injection ports, as soon as the fuel is mixed with the assist air, the mixture is immediately ejected through the adaptor. Consequently, the mixture is diverged into some of the mixture injection ports in an unstable flow condition, and therefore, the fuel cannot be always evenly divided among the mixture injection ports and thus the amount of fuel supplied to an intake port will vary and the combustion of the engine will be unstable.

In addition, due to instability of the flow of the mixture, the directions of movement of the fuel particles are complicated, and thus the mixture ejected from the mixture injection ports is immediately diffused, and accordingly, it is impossible to eject the fuel mixture in the desired direction.

SUMMARY OF THE INVENTION

An object of the present invention is to solve the above-mentioned problem of the conventional fuel injection apparatus.

Therefore, according to the present invention, there is provided a fuel injection apparatus for an internal combustion engine provided with an air-assist unit for atomizing fuel ejected from a fuel injector, by a flow of air, said apparatus having:

a nozzle attached to the fuel-injection end of the fuel injector, a mixture passage provided in the nozzle and positioned in a direction of ejection on the downstream side of a nozzle opening of the fuel injector, to effect a mixing of the ejected fuel and air supplied from the air-assist unit, and mixture injection ports, each of which are formed in the nozzle so as to be shorter than a length of the mixture passage and to be connected to an end thereof, to thereby diverge the mixture of the fuel and the air flowing in the mixture passage to desired directions.

Namely, according to the present invention, since the nozzle having a mixture passage longer than the length of each mixture injection port is attached to the fuel-injection end of the fuel injector, the flow direction of the mixture of the fuel and the assist air will be stabilized while flowing in the mixture passage (i.e., due to flow time and flow distance), so that the mixing of the fuel with the air can be made more equal, and further, a share of fuel distributed at a diverging point can be calculated correctly.

The present invention will be more fully understood from the description of the preferred embodiment thereof set forth below, together with the accompanying drawings.

DESCRIPTION OF THE PREFERRED EMBODIMENTS

Figure 1:
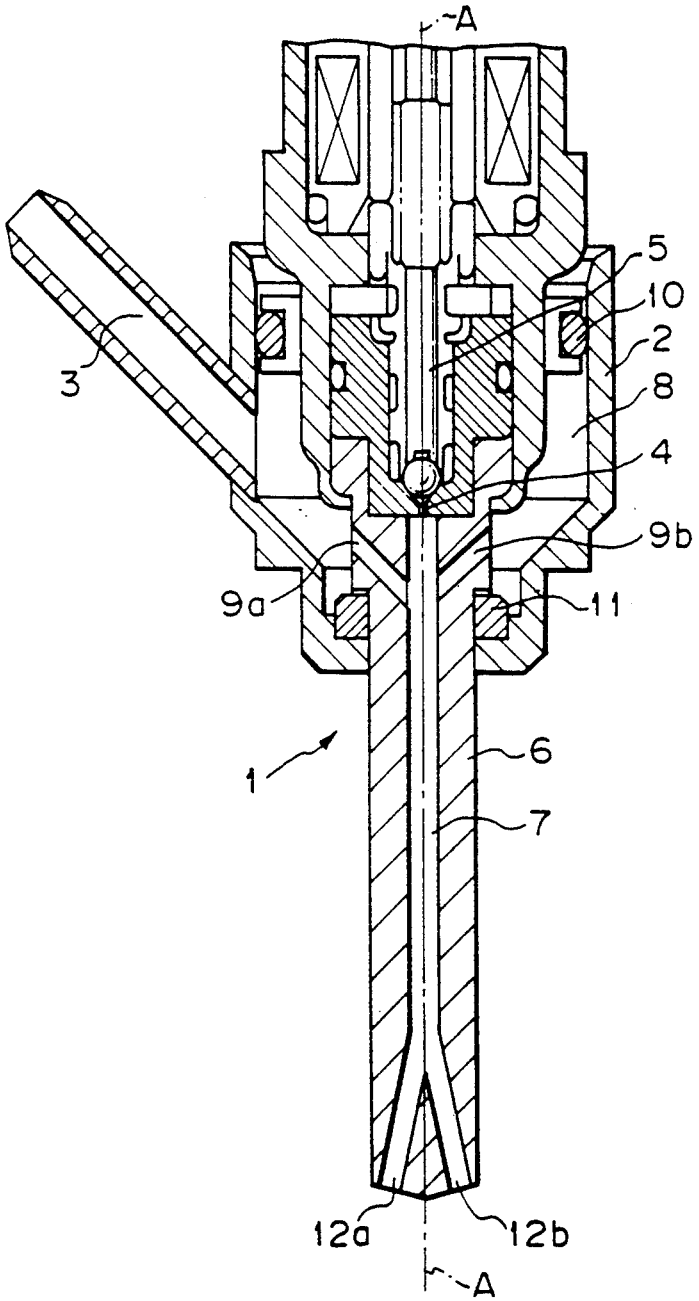
FIG. 1 is a longitudinal sectional view of a fuel injection apparatus according to a first embodiment of the invention.

FIG. 1 shows a fuel injection apparatus of the first embodiment according to the present invention.

In FIG. 1, reference numeral 1 designates a fuel injector, 2 is an air-delivery unit constituting one element of an air-assist unit and distributing assist air supplied from an air-assist unit body (not shown) to a periphery of the fuel injector 1, and 3 is an air pipe through which a pressurized air, i.e., the assist air, is supplied from an air pump (not shown in the figure).

The fuel injector 1 is provided on a center line A thereof with a fuel injection nozzle opening 4 (hereinafter referred to as a nozzle opening) and a needle valve 5 is mounted in the fuel injector 1 in alignment with the nozzle opening 4, so as to reciprocate along the line A.

In the fuel injection apparatus constructed according to this embodiment, a long nozzle 6 is attached at the fuel-injection end of the fuel injector 1, along the center line A thereof.

The long nozzle 6 is provided with a mixture passage 7 formed in such a manner that it extends in the nozzle 6 along the line A, from the nozzle opening 4 to a point downstream of the fuel flow.

Further, the long nozzle 6 is provided with air-assist holes 9*a* and 9*b* communicating the mixture passage 7 with a chamber 8 defined by the air-delivery unit 2. Namely, the mixture passage 7 provides a space for mixing the fuel ejected from the nozzle opening 4 with the assist air supplied from the air-assist unit, to thereby atomize the fuel. Note that an O-ring 10 and an insulator 11, both of which serve to seal the chamber 4 from the outside, are arranged between the fuel injector 1 equipped with the long nozzle 6 and the air-delivery unit 2.

Two mixture injection ports 12*a* and 12*b*, connected to an end of the mixture passage 7, are formed at the fuel-injection end of the long nozzle 6. The mixture injection ports 12*a* and 12*b* are formed in such a manner that the length thereof is shorter than the length of the mixture passage 7.

Also, according to this embodiment, each mixture injection port 12*a*, 12*b* is formed and inclined by a predetermined angle to the center line A, in such a manner that two mixture flows, which are bifurcated at the end of the mixture passage 7 (i.e., the diverging point), are ejected for two intake valves (not shown).

The above-mentioned fuel injection apparatus operates as follows.

In operation, the fuel in the fuel injector 1 is ejected from the nozzle opening 4 to the mixing passage 7 by the activation of the needle valve 5. Further, the pressurized air from the air-assist unit is supplied into the air-delivery unit 2 through the air pipe 3, and the air then discharged into the mixing passage 7 through the air-assist holes 9*a* and 9*b*.

Since a point of contact between the air-assist holes 9*a* and 9*b* and the mixing passage 7, where the fuel and the assist air are mixed, is positioned close to the nozzle opening 4, the fuel ejected from the fuel injector 1 collides with the air ejected from the air-assist holes 9*a* and 9*b*, to thereby cause the fuel to be immediately atomized. Then, the fuel atomized as mentioned above flows in the mixing passage 7 to the fuel-injection end of the long nozzle 6 and during this flow, the atomized fuel is thoroughly mixed with the assist air, and thus the flow directions thereof are made more equal.

Then, the mixing degree of the mixture is stabilized and the flow directions are divided equally at the connecting point of the mixture injection ports 12*a* and 12*b*, through which the divided mixtures are ejected to intake valves (not shown in this figure), respectively. Consequently, even after the mixture is divided, the fuel share in each part of the mixture can be stabilized.

Note, regarding the formation of the above-mentioned passages, it has been found that if the air-assist holes 9*a* and 9*b*, the mixing passage 7 and the mixture injection ports 12*a* and 12*b* are formed so that they satisfy the following relationships, the velocity of the assist air passing through the air-assist holes 9*a* and 9*b* will attain a highest value, and thus the atomization of fuel is further improved.

$$2\cdot(D_{12})^2 > (D_7)^2 > 2\cdot(D_9)^2$$

where $D_{12}$: an inner diameter of the mixture injection port 12*a* or 12*b*

$D_7$: an inner diameter of the mixture passage 7

$D_9$: an inner diameter of the air-assist hole 9*a* or 9*b*

Figure 2:
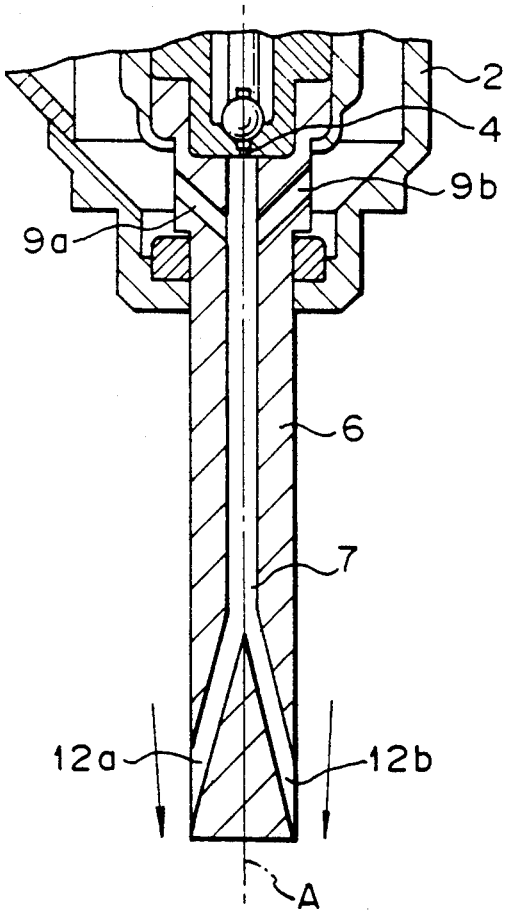
FIG. 2 shows a modification of the first embodiment of FIG. 1, according to a second embodiment of the invention.

FIG. 2 shows a second embodiment of the present invention, including a modification of the form of the mixture injection ports 12*a* and 12*b* shown in the previous embodiment. Note, in figures, including FIG. 2, described hereinafter, elements similar to those of the first embodiment are indicated by the same reference numerals.

Different to the first embodiment, wherein the mixture injection ports 12*a* and 12*b* are open at the end surface of the long nozzle 6, according to this embodiment the ports 12*a* and 12*b* are open at a side surface near the fuel-injection end of the long nozzle 6. Namely, due to the lateral arrangement of the ports 12*a* and 12*b*, the collision force of the air flowing in an intake port, indicated by arrows in the figure, with the mixture discharged from the ports 12*a* and 12*b* can be increased, to thereby improve the atomization of the ejected fuel.

Figure 3:
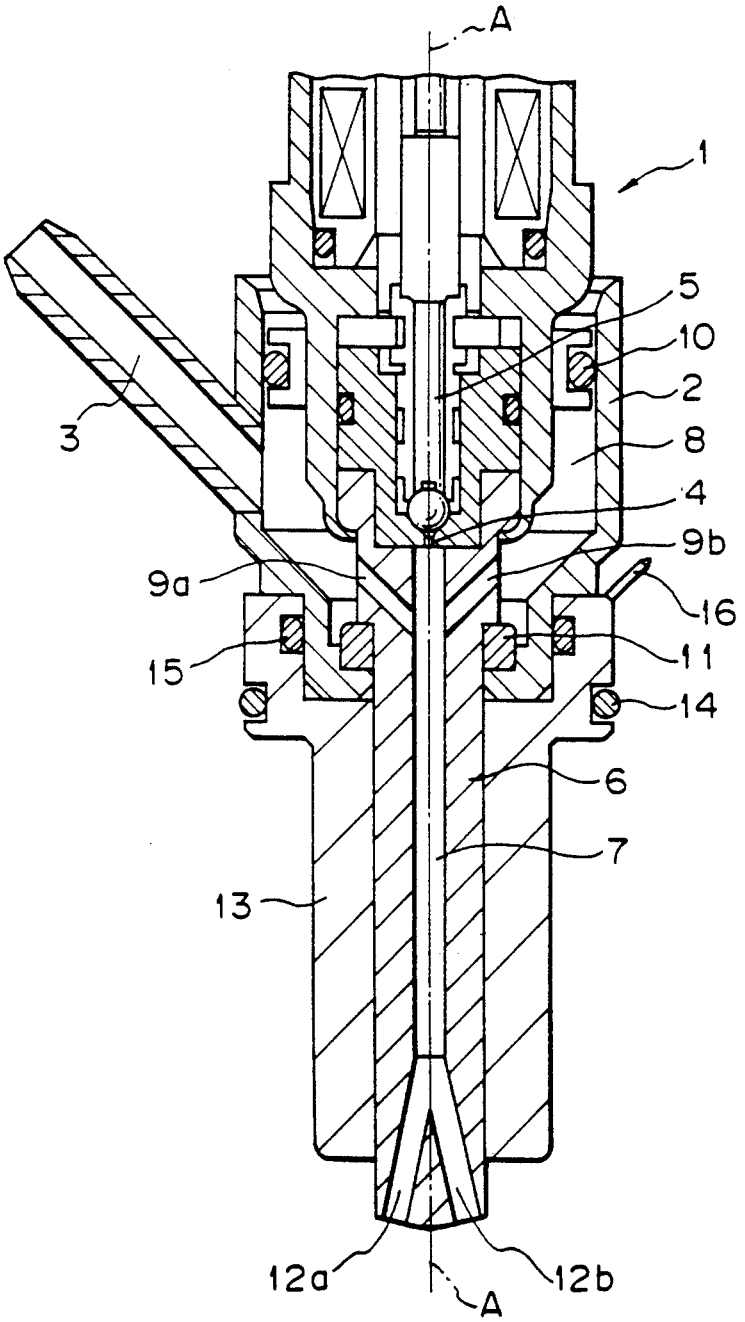
FIG. 3 is a longitudinal sectional view of the apparatus according to a third embodiment of the invention.

FIG. 3 shows a third embodiment of the invention.

According to this embodiment, as a means for heating the mixture passage 7 of the long nozzle 6, a semicylindrical heater 13 is attached to the fuel injector 1 in such a manner that the long nozzle 6 is surrounded by the heater 13. Note, in this figure, reference numerals 14 and 15 designate O-rings, and 16 is a terminal for the heater 13.

In operation, when an engine coolant temperature is low, such as at cold starting, the heater 13 is energized to generate heat prior to an engine start up. Consequently, including the mixture injection ports 12*a* and 12*b*, the mixing passage 7 of the long nozzle 6 is heated, whereby fuel and droplets (including ice particles caused by icing) stuck on an inner wall of the passage 7 will be vaporized and ejected through the ports 12*a* and 12*b*. Further, even after engine start up, when the engine coolant temperature is still low, the heater 13 may be activated so that the atomization of the fuel stuck on the wall can be improved.

The heater 13 may be constructed as a PTC heater (Positive Temperature Coefficient heater) having a thermal property such that a resistance thereof is increased at temperatures over a certain temperature (Curie point). When using such a PTC heater, not only is the temperature thereof rapidly elevated when the engine coolant temperature is low, but also a heat-generation thereof is restricted due to the interception of a current when the temperature of the fuel injection apparatus is increased to a point such that any possibility of sticking fuel or droplets is diminished.

Figure 4:
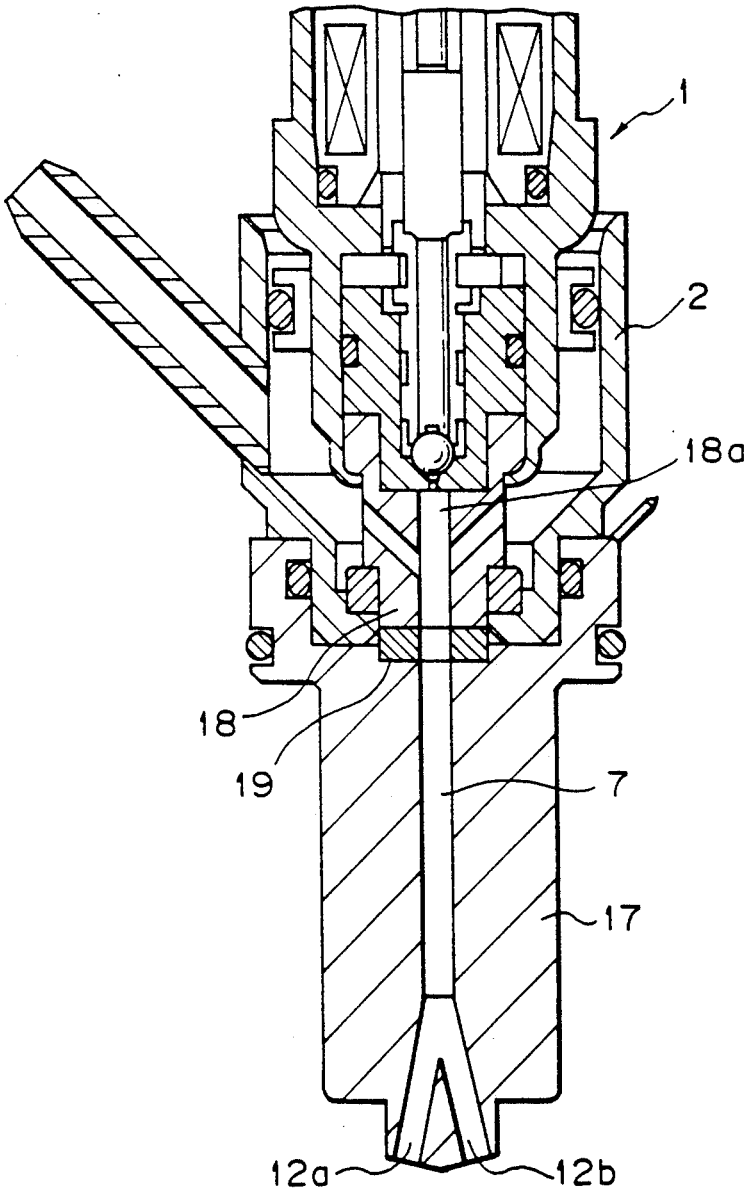
FIG. 4 shows a modification of the third embodiment of FIG. 3, according to a fourth embodiment of the invention.

FIG. 4 shows a modification of the heater in accordance with a fourth embodiment of the invention.

According to this embodiment, the fuel injection apparatus includes a heater 17 which also functions as the long nozzle 6 shown in the previous embodiments. Therefore, the heater 17 itself is provided with the mixture passage 7 and the mixture injection ports 12*a* and 12*b* are formed therein. In this arrangement, the heater 17 constructed as above is attached to an adaptor 18 mounted on the fuel-injection end of the fuel injector 1, through the intermediary of a heat insulating ring 19. The adaptor 18 has a mixture passage 18*a* formed at the center thereof, which communicates with the mixture passage 7 of the heater 17.

In operation, similar to the third embodiment, the heater 17 is activated to heat the mixture passage 7, to thereby improve the atomization of the fuel ejected from the fuel injector 1. Further, the heat insulating ring 19 serves to prevent a transmitting of the heat generated by the heater 17 to the injector 1, whereby the generation of bubbles in the fuel contained therein is prevented.

Figure 5:
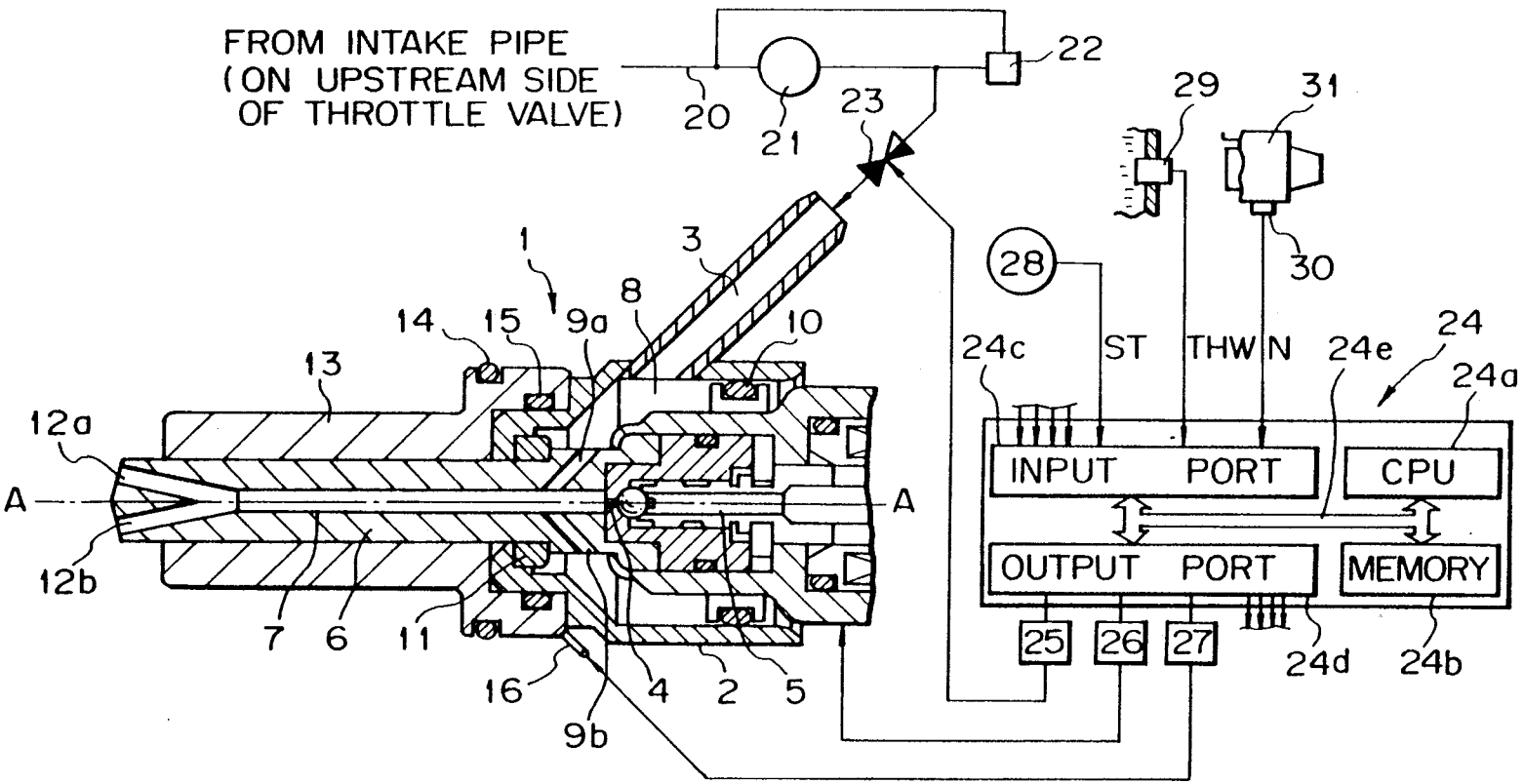
FIG. 5 is a schematic view of a system for controlling the operation of the fuel injector shown in FIG. 3.

FIG. 5 shows a fuel injection system by which the operation of the afore-mentioned fuel injector equipped with the heater is controlled, using as an example the injector 1 according to the third embodiment.

In FIG. 5, reference numeral 20 designates an assist air passage through which air from an intake pipe (not shown) on the upstream side of a throttle valve (not shown) flows to the air pipe 3 of the fuel injection, and 21 is an air pump arranged in the assist air passage 20, to pressurize the air.

Provided on the downstream side of the air pump 21 are a regulating valve 22 for controlling the pressure of the assist air to a constant value, and an air control valve 23 controlled by a control circuit 24, via a drive circuit 25, to open or shut the assist air passage 20.

The control circuit 24 is constructed by a microcomputer comprising a microprocessing unit (CPU) **24*a*, a memory 24*b* such as a ROM (Read Only Memory) and a RAM (Random Access Memory), an input port 24*c*, an output port 24*d*, and a bus 24*e*** interconnecting these components.

In addition to the air control valve 23, the fuel injector 1 and the heater 13 are electrically connected to the output port **24*d* of the control circuit 24 through drive circuits 26 and 27, respectively, whereby the control circuit 24** can control the respective operations thereof.

Input to the input port **24*c* of the control circuit 24 are a start signal ST generated by an ignition switch 28, a coolant temperature signal THW generated by a coolant temperature sensor 29, and an engine speed signal N generated by an engine speed sensor 30 (or a crank angle (CA) sensor) mounted on a distributer 31. Based on the actual driving condition detected by these sensors, the control circuit 24 controls the operations of the fuel injector 1, the air control valve 23, and the heater 13**, etc.

Figure 6:
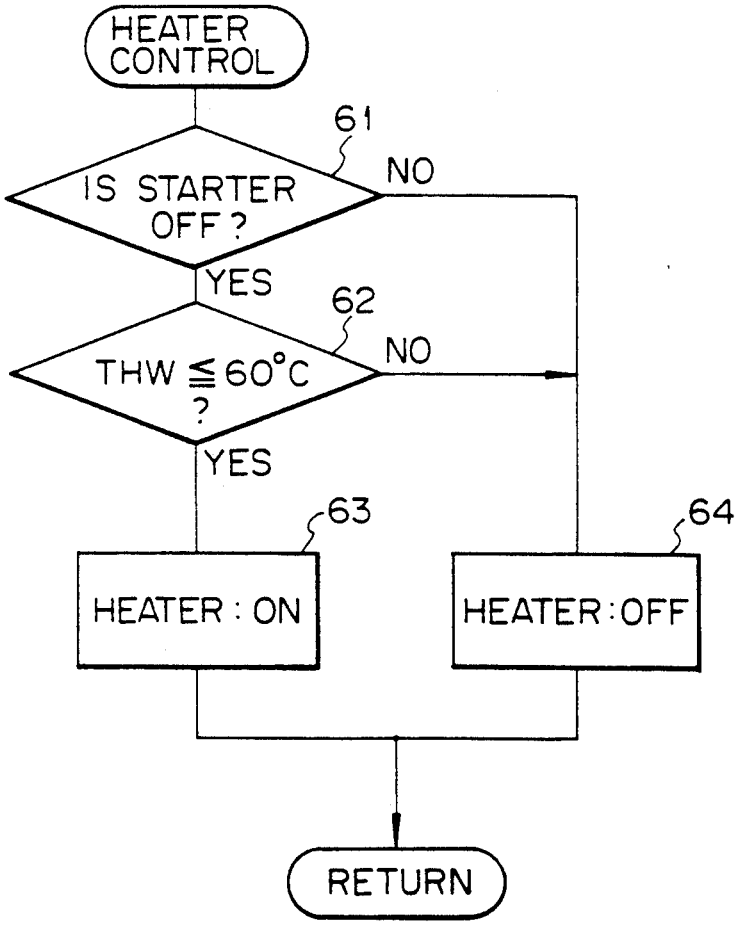
FIG. 6 is a flow chart for controlling an operation of a heater in FIG. 5.

FIG. 6 illustrates a flow chart for executing the control of the operation of the heater 13, by way of an example.

As shown in the figure, at step 61, by the output from the ignition switch 28, it is determined whether or not the start signal ST has been generated (a starter OFF condition).

If the result at step 61 is NO, i.e., the signal ST has been generated to start the engine (ON), the routine goes to step 64 and the power supply to the heater 13 is stopped to ensure that the electric power required to start the engine is available.

Conversely, if the result at step 61 is Yes, i.e., just before or after the starting of the engine, the process goes to step 62 and it is determined whether or not the coolant temperature calculated from output signals THW of the coolant temperature sensor 29 is less than 60° C., i.e., whether or not the engine is cold.

If the result at step 62 is Yes (the engine is cold), the process goes to step 63 and a drive signal is output to the drive circuit 27 to make the heater ON, whereby the mixture passage 7 is heated to improve the atomization of the fuel.

Conversely, if the result at step 62 is NO, i.e., the engine is warming-up, the routine goes to step 64 and the heater 13 is inactivated, since there is no possibility of a sticking of the fuel or the existence of droplets on the inner wall of the mixture passage 7 or at the fuel-injection end of the long nozzle 6.

After step 63 or 64, the routine is ended and returns to step 61, and the routine sequence is again carried out in the same way.

Figure 7:
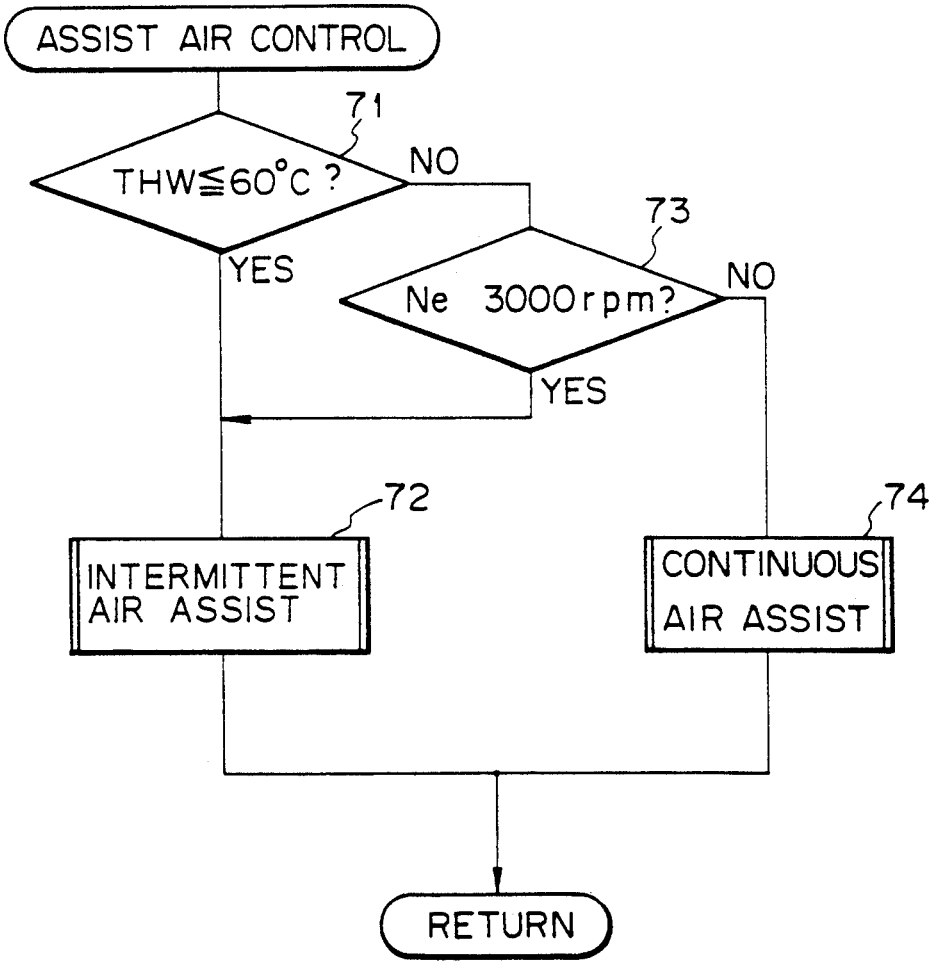
FIG. 7 is a flow chart for controlling the operations of an assist-air valve in FIG. 5.

FIG. 7 illustrates a flow chart for executing the control of the operation of the assist air control valve 23.

As shown in the figure, at step 71 it is determined whether or not the coolant temperature calculated from the output signals THW of the coolant temperature sensor 29 is less than 60° C., i.e., whether or not the engine is cold.

If the result at step 71 is YES, i.e., the engine is cold, the routine goes to step 72 and an intermittent air assist process, described in detail hereafter, is executed because, if the assist air is introduced continuously under such a condition, the long nozzle 6 may be overcooled.

Further, if the result at step 71 is NO, the routine goes to step 73 and it is determined whether or not the engine speed calculated by the output signals N of the engine speed sensor 30 is less than a relative small predetermined value (e.g., 3000 r.p.m.).

If the result at step 73 is YES, i.e., the engine is driven in a low speed area, the routine goes to step 72 and the intermittent air assist process is executed This is because, if the present driving condition is an idling or low speed condition, i.e., under a low load for which the amount of ejected fuel is small and if the assist air is continuously supplied by the air-assist unit, the engine speed is increased due to an excess of intake air, and accordingly, any increase of an amount of intake air must be limited by the intermittent air assist operation.

Further, if the result at step 73 is NO, i.e., when the engine is warm and is not driven in a low speed condition, the routine goes to step 74 and a continuous air assist process is executed to open the air control valve 23. After step 74, the routine is ended and returns to step 71, and the routine sequence is again carried out in the same way.

Figure 8:
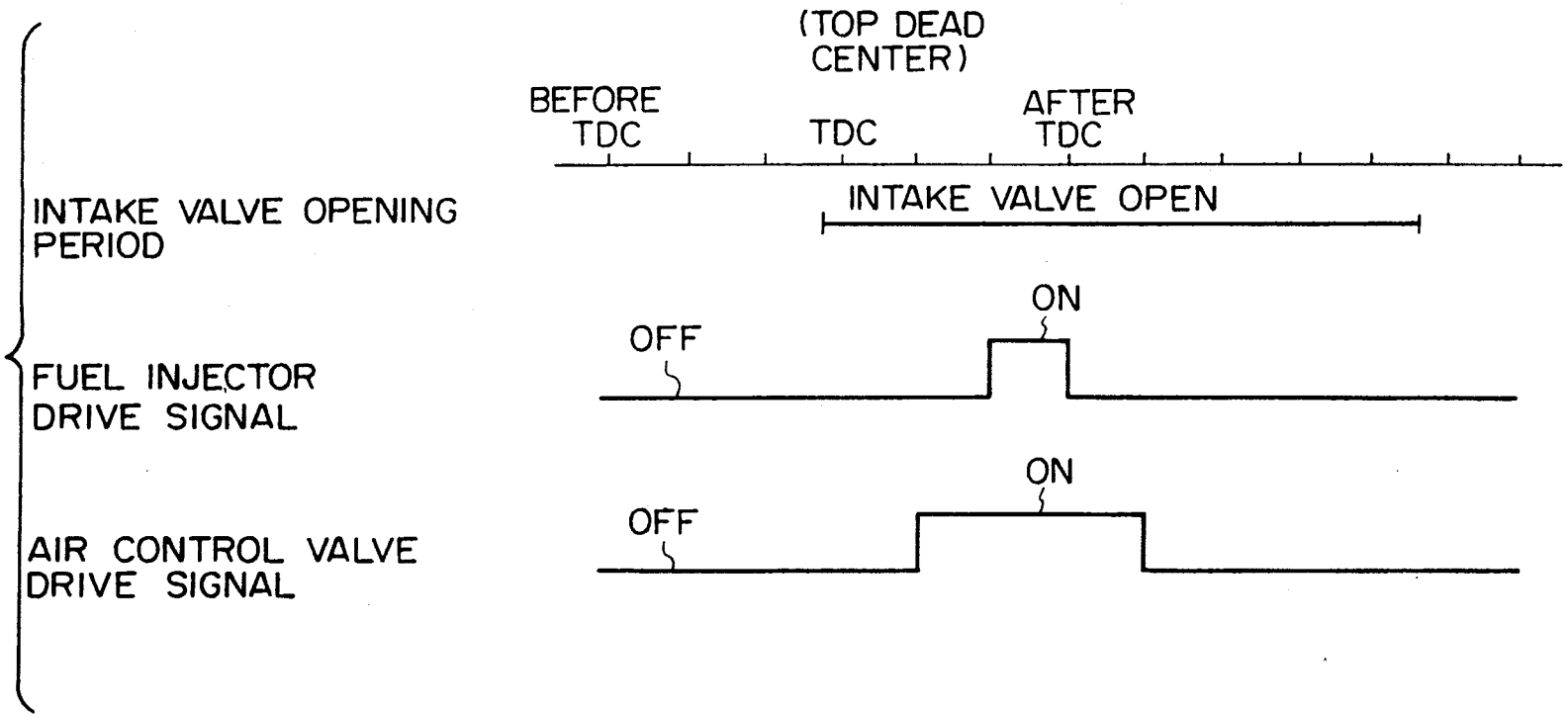
FIG. 8 is a diagram of the operations of the assist-air valve, carried out in accordance with the flow chart of FIG. 7.

FIG. 8 illustrates timing charts explaining an example of the intermittent air assist process, in which a traverse axis designates crank angles representing a passing of time, the upper chart shows a period of opening of an intake valve of a certain cylinder, the middle chart shows a period of a generation of an output signal for driving the fuel injector 1 at the cylinder, i.e., a fuel injection period, and the lower chart shows a period of a generation of an output signal for opening the air control valve 23, i.e., an air-assist period.

As is apparent from this figure, in the intermittent air assist process in accordance with this embodiment, when the coolant temperature is low or when the engine speed is low after warming-up, the air-assist is executed in a short period, including the fuel injection period, to improve the atomization of the ejected fuel. Namely, due to the above intermittent supply of air, an overcooling of the mixture passage 7 when the engine is cold or an increase of the engine speed due to an excess of intake air, can be prevented.

Note, it will be understood by those skilled in the art that the driving of the air control valve 23, which attains the afore-mentioned continuous and intermittent air assist processes, is controlled by the control circuit 24 based on a program for outputting an ON signal to the drive circuit 25 for a predetermined period (at a predetermined crank angle) including the fuel injection period, when the result at either step 71 or step 73 is YES.

Further, although the periods for which the air-assist stopped when the result is YES at either step 71 or step 73 are identical in this embodiment, these periods may be made different from each other, according to need.

Figure 9:
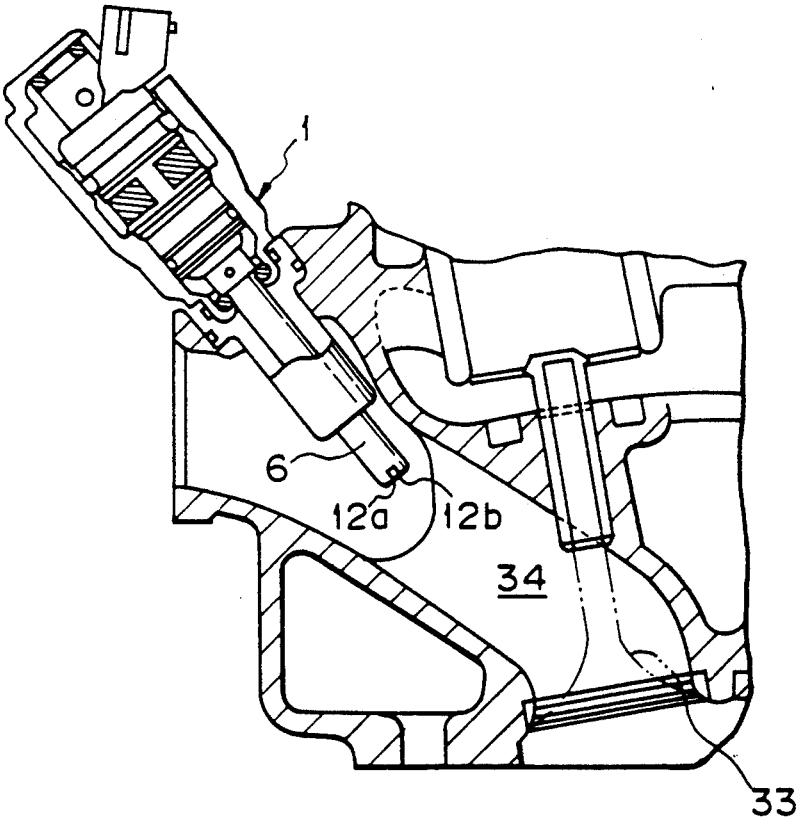
FIG. 9 is a longitudinal sectional view of a cylinder head equipped with the fuel injector shown in FIG. 1.

FIG. 9 shows a configuration of mounting the fuel injection apparatus described above.

As shown in this figure, since the fuel injection apparatus of the embodiment includes the long nozzle 6 at the fuel-injection of the fuel injector 1, the nozzle opening of the apparatus, i.e., the mixture injection ports 12*a* and 12*b*, can be positioned closer to an intake valve 33 even if a position at which the injector 1 is mounted is far from the intake valve 33. Consequently, an adhering of ejected fuel to the walls of an intake port 34 can be lessened, in comparison with the conventional fuel injector not having the long nozzle 6.

Figure 10:
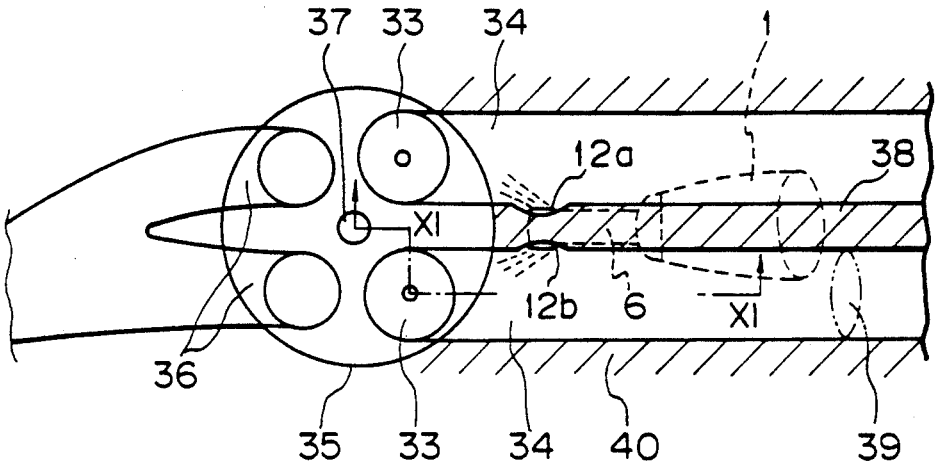
FIG. 10 is a traverse sectional view of a cylinder, showing a modification of the mounting form shown in FIG. 9.
Figure 11:
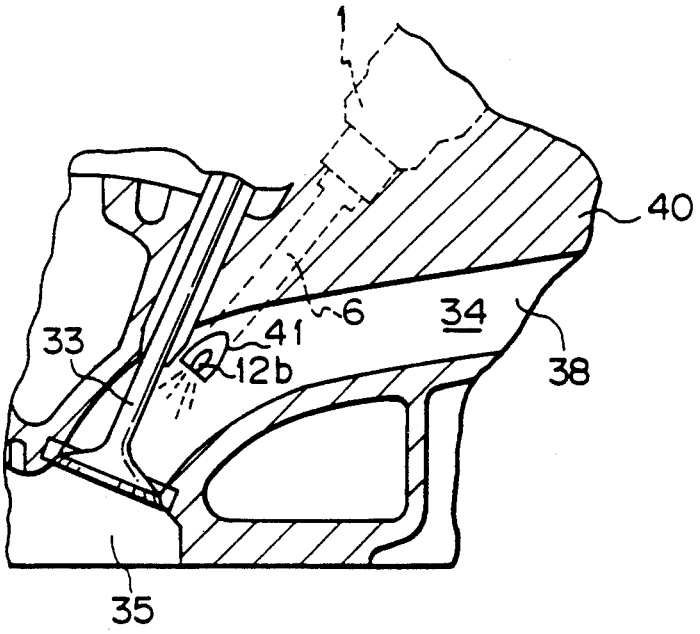
FIG. 11 is a sectional view taken along a line XI—XI in FIG. 10.

FIGS. 10 and 11 show a modification of a mounting of the fuel injection apparatus, in which the mixture injection ports 12*a* and 12*b* are closer to the intake valves 33 than as shown in FIG. 9.

In these figures, reference numeral 35 designates a cylinder, 36 exhaust ports, 37 a spark plug, 38 a separating wall, 39 an intake control valve, 40 a cylinder head, and 41 an opening through which the long nozzle 6 of the apparatus is exposed in the intake port 34.

As shown in FIG. 11, the fuel injection apparatus is arranged in such a manner that the long nozzle 6 is extending downward from a part of the cylinder head 40 above the separating wall 38, and thus the mixture injection ports 12*a* and 12*b* are exposed in the intake ports 34.

According to this embodiment, by inserting the long nozzle 6 into the separating wall 38, it is possible to reduce the distance between the mixture injection ports 12*a*, 12*b* and the intake valves 33, in comparison with the embodiment of FIG. 9, so that the amount of fuel adhering to the inner walls of the intake ports 34 can be reduced to thereby stabilize the air-fuel ratio of the mixture introduced into the cylinder 35.

Further, according to this embodiment, since the fuel-injection end of the long nozzle 6 is supported by a part of the separating wall 38, it does not vibrate as much as the engine body, and thus the accuracy of the directions in which the mixture is ejected is increased.

It will be understood by those skilled in the art that, in this embodiment, the openings 41 are formed in the separating wall 38, since the thickness thereof is larger than the diameter of the long nozzle 6, but it is, of course, possible that, where the minimum thickness of the former is smaller than the latter, there would be no need to form the openings in the separating wall because the mixture injection ports can be easily exposed in the intake ports as is.

Figure 12:
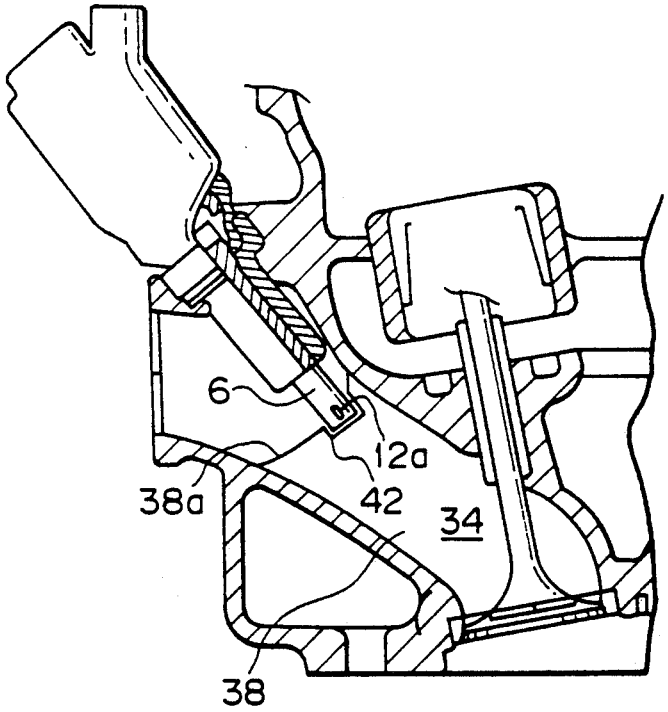
FIG. 12 is a modification of the mounting form shown in FIG. 11.

FIG. 12 illustrates a modification of the embodiment shown in FIGS. 10 and 11.

According to this embodiment, the fuel-injection end of the long nozzle 6 is engaged in a recess 42 formed at the front edge 34*a* of the separating wall 34. Therefore, also in this embodiment, the nozzle 6 is supported by a part of the separating wall 34, whereby a vibration of the fuel injection apparatus can be restrained as in the previous embodiment.

Although the means for supporting the long nozzle 6 in the above embodiments comprises a part of the separating wall 38, various changes and modifications can be thereto. For example, when the fuel injection apparatus is applied for a single intake port (not shown), the supporting means may be an inner wall thereof. Further, in other cases, a supporting member arranged in the intake port may be provided.

Finally, although the foregoing embodiments of the present invention have been described with reference to the attached drawings, many modifications and changes may be made thereto by those skilled in this art without departing from the scope of the invention.

We claim:

1. A fuel injection apparatus for an internal combustion engine provided with an air-assist unit for atomizing fuel ejected from a fuel injector, said apparatus having:

a nozzle attached to the fuel-injection end of said fuel injector;

a mixture passage provided in said nozzle and positioned in a direction of ejection on the downstream of side of a nozzle opening of said fuel injector, to thereby effect a mixing of the ejected fuel and air supplied from said air-assist unit;

means for heating said mixture passage, wherein said means for heating includes a heater surrounding said nozzle; and mixture injection ports, each formed in said nozzle so as to be shorter than a length of said mixture passage, and to be connected with an end thereof, to thereby diverge said mixture of fuel and air flowing said mixture passage in desired directions.

2. A fuel injection apparatus according to claim 1, wherein said air-assist unit includes an air-delivery unit for distributing said assist air to a periphery of said fuel injector.

3. A fuel injection apparatus according to claim 2, wherein said nozzle is provided with air-assist holes communicated with a chamber defined by said air-delivery unit.

4. A fuel injection apparatus according to claim 1, wherein said mixture injection ports of said nozzle are open at an end surface thereof.

5. A fuel injection apparatus according to claim 1, wherein said mixture injection ports of said nozzle are open at a side surface thereof, in the vicinity of a fuel-injection end thereof.

6. A fuel injection apparatus according to claim 1, wherein said heating means is activated to generate a heat prior to an engine start-up when an engine coolant temperature is less than a first predetermined value.

7. A fuel injection apparatus according to claim 1, wherein said nozzle comprises an adaptor attached to the fuel-injection end of said fuel injector, and a heater provided with said mixture passage and said mixture injection ports and functioning as said heating means.

8. A fuel injection apparatus according to claim 7, wherein a heat insulating ring is arranged between said adaptor and said heater, to thereby prevent a transmission of heat to said fuel injector.

9. A fuel injection apparatus according to claim 6, further comprising means for stopping an air supply to said mixture passage, wherein said stopping means executes an intermittent air assist process at least when said heating means is activated.

10. A fuel injection apparatus according to claim 9, wherein said air-assist unit comprises an assist air passage in which the air flows, and wherein said stopping means comprises an air control valve arranged in said assist air passage of said air-assist unit to open or close said assist air passage, and a control circuit for controlling an operation of said air control valve.

11. A fuel injection apparatus according to claim 10, further comprising an ignition switch, a coolant temperature sensor and an engine speed sensor, said ignition switch, said coolant temperature sensor and said engine speed sensor being electrically connected to said control circuit to control the operation of said air control valve.

12. A fuel injection apparatus according to claim 11, wherein said stopping means also executes said intermittent air assist process when the engine speed detected by said engine speed sensor is less than a second predetermined value.

13. A fuel injection apparatus according to claim 12, wherein the air-assist is limited to a short period including a fuel injection period during said intermittent air-assist process.

14. A fuel injection apparatus according to claim 3, wherein said air-assist holes, said mixing passage and said mixture injection ports are formed under a condition which satisfies the relationships;

$$2\cdot(D_{12})^2>(D_7)^2>2\cdot(D_9)^2$$

where $D_{12}$: an inner diameter of said mixture injection port, $D_7$: an inner diameter of said mixture passage and, $D_9$: an inner diameter of said air-assist hole.

15. A fuel injection apparatus according to claim 1, wherein said apparatus is arranged in an intake port provided with two intake valves, of said internal combustion engine, and wherein said fuel injector is positioned outside of said intake port so that said nozzle attached to said fuel injector protrudes into said intake port in the direction of said intake valves and so that each of said mixture injection ports is directed to a respective intake valve.

16. A fuel injection apparatus according to claim 15, wherein, when mounting said apparatus to a cylinder head, said nozzle is inserted to a wall by which each intake port is defined, whereby a fuel-injection end of said nozzle is supported by a part of said wall.

17. A fuel injection apparatus according to claim 15, wherein, when mounting said apparatus to a cylinder head, said fuel-injection end of said nozzle is engaged in a recess formed at a front edge of a wall by which each intake port is defined.

* * * * *